US007392636B2

(12) United States Patent
Conti

(10) Patent No.: US 7,392,636 B2
(45) Date of Patent: Jul. 1, 2008

(54) METHOD AND APPARATUS FOR MAKING PODS FOR PRODUCTS FOR INFUSION

(75) Inventor: Roberto Conti, Imola (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/566,717

(22) PCT Filed: Jul. 23, 2004

(86) PCT No.: PCT/IB2004/002502

§ 371 (c)(1),
(2), (4) Date: Feb. 1, 2006

(87) PCT Pub. No.: WO2005/012099

PCT Pub. Date: Feb. 10, 2005

(65) Prior Publication Data

US 2006/0201113 A1 Sep. 14, 2006

(30) Foreign Application Priority Data

Aug. 1, 2003 (IT) ..... BO2003A0474

(51) Int. Cl.
*B65B 29/02* (2006.01)
*B65B 31/00* (2006.01)
*B65B 9/04* (2006.01)

(52) U.S. Cl. ..... 53/433; 53/438; 53/450; 53/511; 53/529; 53/553

(58) Field of Classification Search ..... 53/436, 53/527, 553, 450, 122, 528, 529, 433, 511, 53/555, 438; 100/177, 178, 238
See application file for complete search history.

(56) References Cited

U.S. PATENT DOCUMENTS

| | | | | | |
|---|---|---|---|---|---|
| 1,481,866 | A | * | 1/1924 | Heist | 156/199 |
| 2,472,440 | A | * | 6/1949 | Salfisberg | 53/135.3 |
| 3,186,141 | A | * | 6/1965 | Zimmermann | 53/559 |
| 3,418,140 | A | | 12/1968 | Fisher | |
| 3,579,350 | A | * | 5/1971 | Rudd et al. | 426/79 |
| 4,034,536 | A | | 7/1977 | Mahaffy et al. | |
| 4,265,070 | A | * | 5/1981 | Mainberger et al. | 53/433 |
| 4,437,294 | A | | 3/1984 | Romagnoli | |
| 4,555,894 | A | * | 12/1985 | Illy | 53/528 |
| 4,609,556 | A | | 9/1986 | Goedert | |
| 4,747,250 | A | * | 5/1988 | Rossi | 53/511 |
| 4,852,333 | A | * | 8/1989 | Illy | 53/436 |
| 4,870,808 | A | * | 10/1989 | Romagnoli | 53/529 |
| 5,233,813 | A | | 8/1993 | Kenney et al. | |
| 6,135,120 | A | | 10/2000 | Löfman et al. | |
| 6,799,409 | B2 | * | 10/2004 | Altvater et al. | 53/122 |
| 2006/0207619 | A1 | * | 9/2006 | Conti | 131/322 |

* cited by examiner

FOREIGN PATENT DOCUMENTS

CH 495 138 8/1970

*Primary Examiner*—Stephen F Gerrity
(74) *Attorney, Agent, or Firm*—Arent Fox LLP

(57) ABSTRACT

A method for making pods (1) for products for infusion comprises the steps of: feeding a first portion (5) of filter material; making a compressed disk (2) of product, the disk being equivalent to a single dose of the product, at respective dosing and forming stations (3, 4); placing the compressed disk (2) on the first portion (5) of filter material; and superimposing a second portion (6) of filter material over the first portion (5) of filter material with the compressed disk (2) on it in such a way as to form the pod (1). The invention also relates to an apparatus that embodies this method.

28 Claims, 4 Drawing Sheets

METHOD AND APPARATUS FOR MAKING PODS FOR PRODUCTS FOR INFUSION

CROSS-REFERENCE TO RELATED APPLICATION

This application is a National Stage entry of International Application Number PCT/IB2004/00250, filed Jul. 23, 2004. The disclosure of the prior application is hereby incorporated herein in its entirety by reference.

TECHNICAL FIELD

The present invention relates to a method and an apparatus for making pods for products for infusion.

BACKGROUND ART

In the current market of products for infusion, such as coffee, barley coffee, tea and camomile, the use of single-dose "pods" has increased considerably and a very popular way of making American-style coffee is now to use such pods in specially designed machines, even for household or office use (that is, for small to medium quantities).

This specification does not concern other forms of filter bags normally used to make American-style coffee and consisting of a "maxi dose" bag designed to be placed in a funnel-like container at the top of a machine that supplies boiling hot water. The hot water comes into contact with the coffee filter bag producing a brew of coffee which is simply allowed to drip into a cup below.

Unlike this type of solution—which is widely used and extremely popular—pods used to brew a single serving of beverage usually consist of two portions of filter paper placed one over the other and sealed to enclose a single product dose of circular shape.

In the specific case of pods for American-style coffee, the product is not (and must not be) excessively compressed, which means that it remains relatively loose inside the pod.

For technical reasons linked to the type of machines used to make them, the pods have an asymmetrical profile, that is to say, with one flat surface (defined by one of the portions of filter paper) and one cupped surface (defined by the other portion of filter paper) containing the dose of infusion product.

One prior art method and related apparatus for making this type of pod is described in patent EP-432.126. The method disclosed therein comprises the following sequence of steps:

- feeding a first web of filter paper to a station where suitable means cause the filter paper to be wrinkled or crinkled;
- moving the web of filter paper along the surface of a forming drum, provided with circular pockets and with suction means, and simultaneously training a belt in contact with the filter paper, with the filter paper being between the belt and the surface of the forming drum, so that spaced areas of the belt are pulled by suction into the pockets in the drum, drawing the filter paper along with it in such a way as to form a succession of pouches in the filter paper;
- filling a dose of product into each pouch by means of a dosing station located downstream of the suction drawing belt in the direction of rotation of the pouch forming drum and consisting of a second revolving drum synchronised with the pouch forming drum;
- joining the first web of filter paper, provided with the product filled pouches, to a second web fed at a respective sealing station located downstream of the filling station, again relative to the direction of rotation of the forming drum;
- cutting out the pods thus made and feeding them out towards further packaging stations.

This method and the apparatus that embodies it have several disadvantages due to:

- the need to pre-process the web of filter paper to make it suitable for forming the pouches, which means that the apparatus requires an additional station; this operation being necessary especially when two or more parallel rows of pouches are formed in the filter paper web; and
- the possible difficulty of accurately controlling the volume of product filled into each pouch on account of the two revolving cylindrical surfaces of the drums (dosing and forming); this can cause a certain amount of product being lost as it is gravity fed into the pouch.

The aim of the present invention is to overcome the above mentioned drawbacks by providing a method and an apparatus for making pods containing products for infusion that is at once practical, fast, reliable in dosing the product and structured in such a way as to require a limited number of operating stations.

DISCLOSURE OF THE INVENTION

According to the invention, this aim is achieved by a method for making pods for products for infusion comprising the steps of: feeding a first portion of filter material; making a compressed disk of product, the disk being equivalent to a single dose of the product, at respective dosing and forming stations; placing the compressed disk on the first portion of filter material; and associating a second portion of filter material over the first portion of filter material with the compressed disk on it in such a way as to form the pod.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate preferred embodiments of the invention provided merely by way of example without restricting the scope of the inventive concept, and in which:

DETAILED DESCRIPTION OF THE PREFERRED EMBODIMENTS OF THE INVENTION

Figure 1:
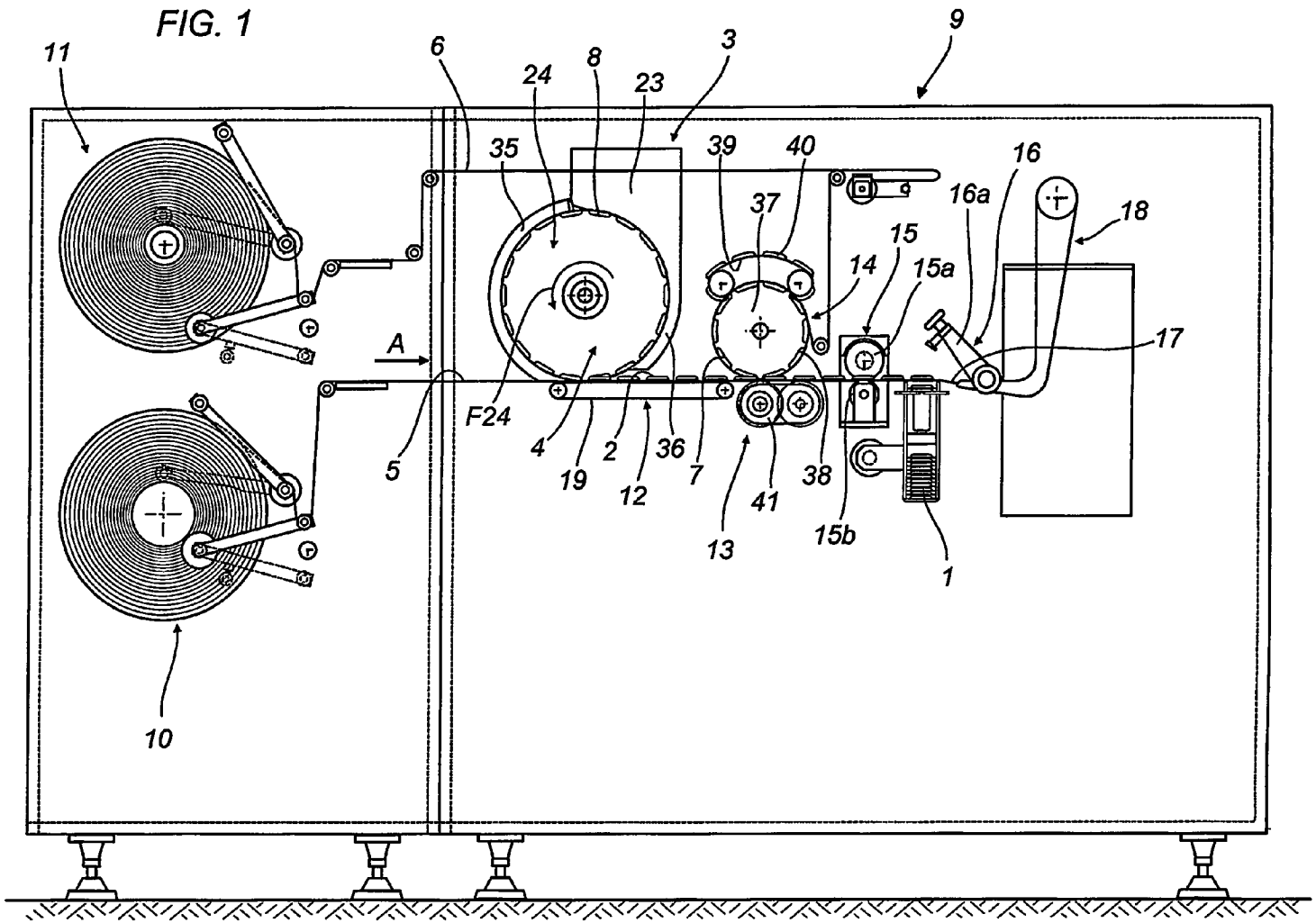
FIG. 1 is a schematic side view of an apparatus according to the present invention for making pods for products for infusion embodying a method for making the pods according to the present invention.
Figure 2:
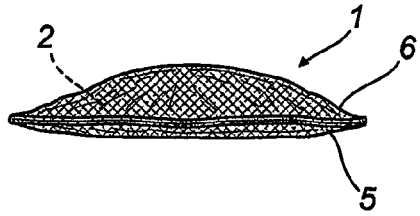
FIG. 2 is a schematic side view of a pod for products for infusion made using the method and apparatus of FIG. 1.

With reference to the accompanying drawings, in particular FIGS. 1 and 2, the method and apparatus according to the invention are used to make pods 1, usually single-dose pods, of filter material containing a product for infusion, such as but not restricted to, a blend of ground coffee.

For simplicity, the term filter paper will be used hereinafter to denote the lengths or webs defining the containers of the infusion product, it being understood that the term paper is used in a non-restrictive sense to include any material suitable for making the filtering part of the pod 1.

The pods 1 have a traditional asymmetrical shape and comprise filter paper enclosing individual doses of product that is not excessively compressed.

The method according to the invention basically comprises the following steps:

making at least one compressed disk 2 of product, equivalent to a dose of the product, at respective dosing and forming stations 3, 4; and forming the pod 1 with the compressed disk 2 positioned inside the filter paper.

During the step of making the disk 2, compression is preferably accomplished by tamping.

More specifically, the pods 1 contain the product enclosed between two lengths 5 and 6 of filter paper that are associated with each other and sealed, the length 5 being substantially flat and the length 6 having a cupped portion for receiving the product disk 2.

In this specific form, the pod 1 is made in the following steps:

feeding a first portion 5 of filter paper;

making the compressed disk 2 of product, equivalent to a dose of the product, at respective dosing and forming stations 3 and 4;

placing the compressed disk 2 on the first portion 5 of filter paper;

associating a second portion 6 of filter paper over the first portion 5 of filter material with the compressed disk 2 on it in such a way as to form the pod 1.

As illustrated in FIG. 1, the first and second portions of filter paper are obtained from webs 5 and 6 of the filter paper and the first web 5 is fed preferably in a straight line.

Alternatively, the first web 5 may follow an inclined feed path (see dashed line in FIG. 3) to partially follow the shape of the forming station 4 so as to facilitate the releasing of the disk 2.

Between the step of placing the compressed disk 2 and the associating step there is a further step of making in the second portion 6 of filter paper a counter-impression 7 shaped to match the disk 2 and designed to be placed over the disk 2.

The step of associating the first and second portions 5 and 6 of filter paper may be accomplished by heat sealing.

It is contemplated that the associating step is followed by a step of cutting the first and second portions 5 and 6 of filter material to form the pod 1, which may, for example, but without restricting the scope of the invention, be circular in shape.

Returning to the step of making the disk 2 (see FIGS. 3 and 5), this may comprise the following sub-steps:

depositing a dosed quantity of the product in a respective impression 8 while moving along a first defined path, labelled P1, within the forming station 4; and compressing the dose of product inside the impression 8 while moving along a second defined path, labelled P2, following the first path P1.

Preferably, the first and second paths P1 and P2 are arc-shaped and cover respective angles ($\alpha$) and ($\beta$) following each other (as described in more detail below).

Again with reference to FIGS. 3 and 5, it is contemplated that between the dosing and compressing sub-steps there is a step of levelling off P3 the dosed product inside the impression 8 so as to obtain exactly the right quantity of product in the impression 8.

The compression step is followed by the aforementioned step of depositing the compressed disk 2 by allowing it to drop out of the respective impression 8 by gravity onto the first portion 5 of filter paper (see FIG. 3) where it is held in place preferably by suction.

The apparatus 9 embodying the method according to the invention as described above essentially comprises the following stations:

two independent stations 10 and 11 for feeding respective webs 5 and 6 of filter paper;

a station 12 for feeding the first web 5 of filter paper in a feed direction A and at least to a station 3 for dosing individual doses of the product into at least one forming impression 8 located on means 4 for forming a respective compressed disk 2 of the infusion product and releasing the disk 2 onto the first web 5 of filter material;

a station 13 for associating the first portion 5 of filter paper with the second web 6 of filter paper to form the pod 1.

The apparatus 9 broadly outlined above may further comprise:

a station 14 located downstream of the dosing and forming station 3 in the feed direction A and designed to make a counter-impression 7 in the second web 6 of filter paper and to place the counter-impression 7 over the product disk 2;

a station 15 located downstream of the associating station 13 and designed to cut off the disk 2 encapsulated in the two webs 5 and 6 of filter paper to form a pod 1 that is, for example, circular in shape;

a station 16 for separating the circular pod 1 from the waste material 17, which is collected in a recovery station 18.

Looking more closely at the constructional details, the feed stations 10 and 11 that unwind the webs 5 and 6 may comprise respective rolls of filter paper.

More specifically, the second web 6 may be wider than the first web 5 so as to better accommodate the compressed disk 2.

Figure 3:
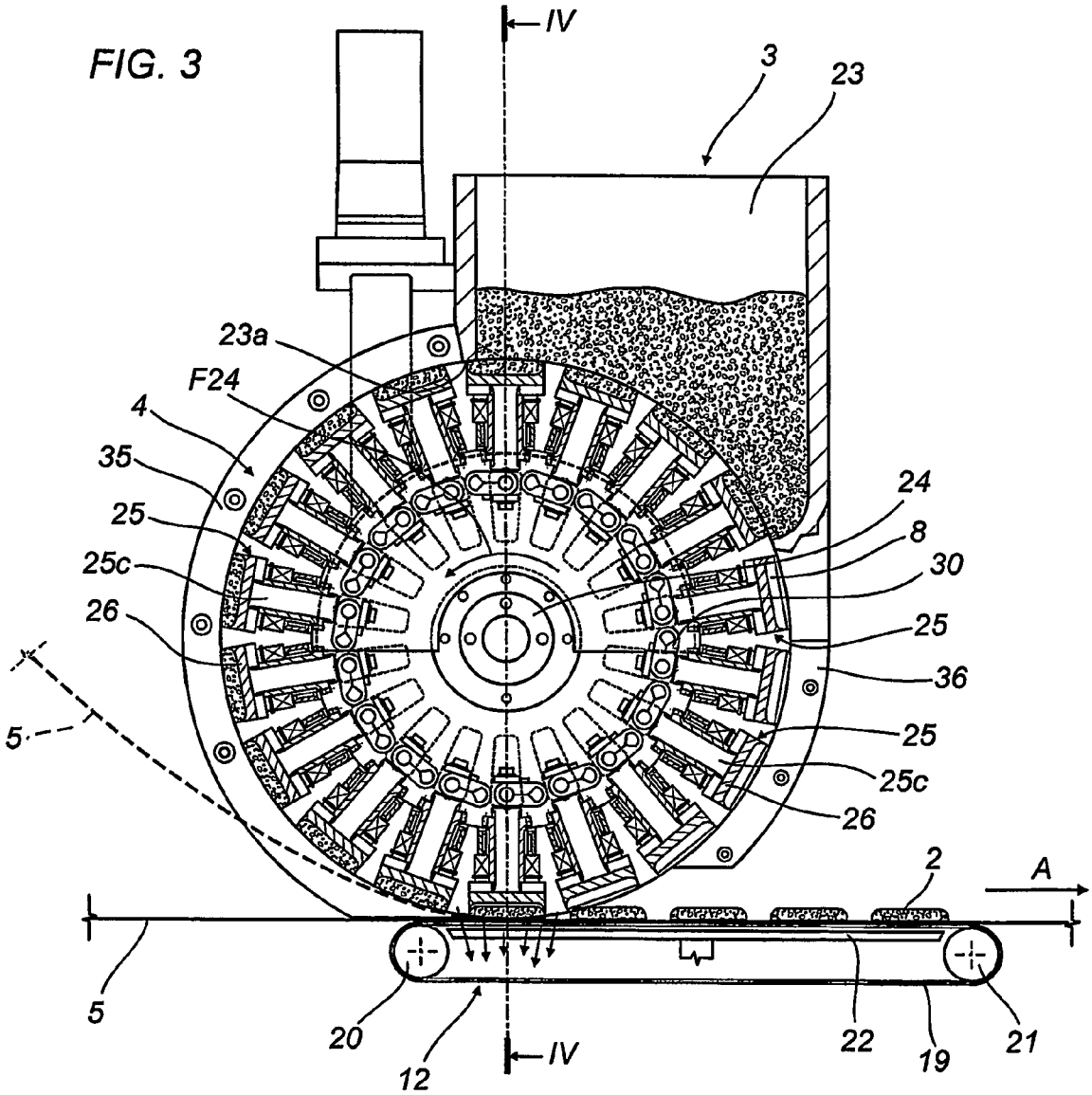
FIG. 3 is a scaled-up view of a station forming part of the apparatus of FIG. 1, that is to say, a side view, with some parts cut away and others in cross section in order to better illustrate certain details, of a station for forming and dosing a disk of product for infusion.

As shown in FIG. 3, the feed station 12 comprises a first endless belt 19, trained around a pair of power driven sheaves 20 and 21.

The surface of the first belt 19 is preferably perforated or porous so as to enable means 22 for creating a vacuum to interact with the working section of the first belt 19: this is the belt section that feeds the first filter paper web 5 and is where the product disk 2 is deposited and held by suction correctly in place on the first filter paper web 5 (the means 22 are illustrated schematically since they are of known type).

With reference to FIG. 3 again, the dosing station 3 comprises a fixed hopper 23 mounted to face a first revolving drum 24 (see arrow F24) forming part of the forming means 4.

The hopper 23 has an arc-shaped discharge portion to peripherally follow a passing surface of the first drum 24 in such manner that the product is dosed in a predetermined area.

Figure 4:
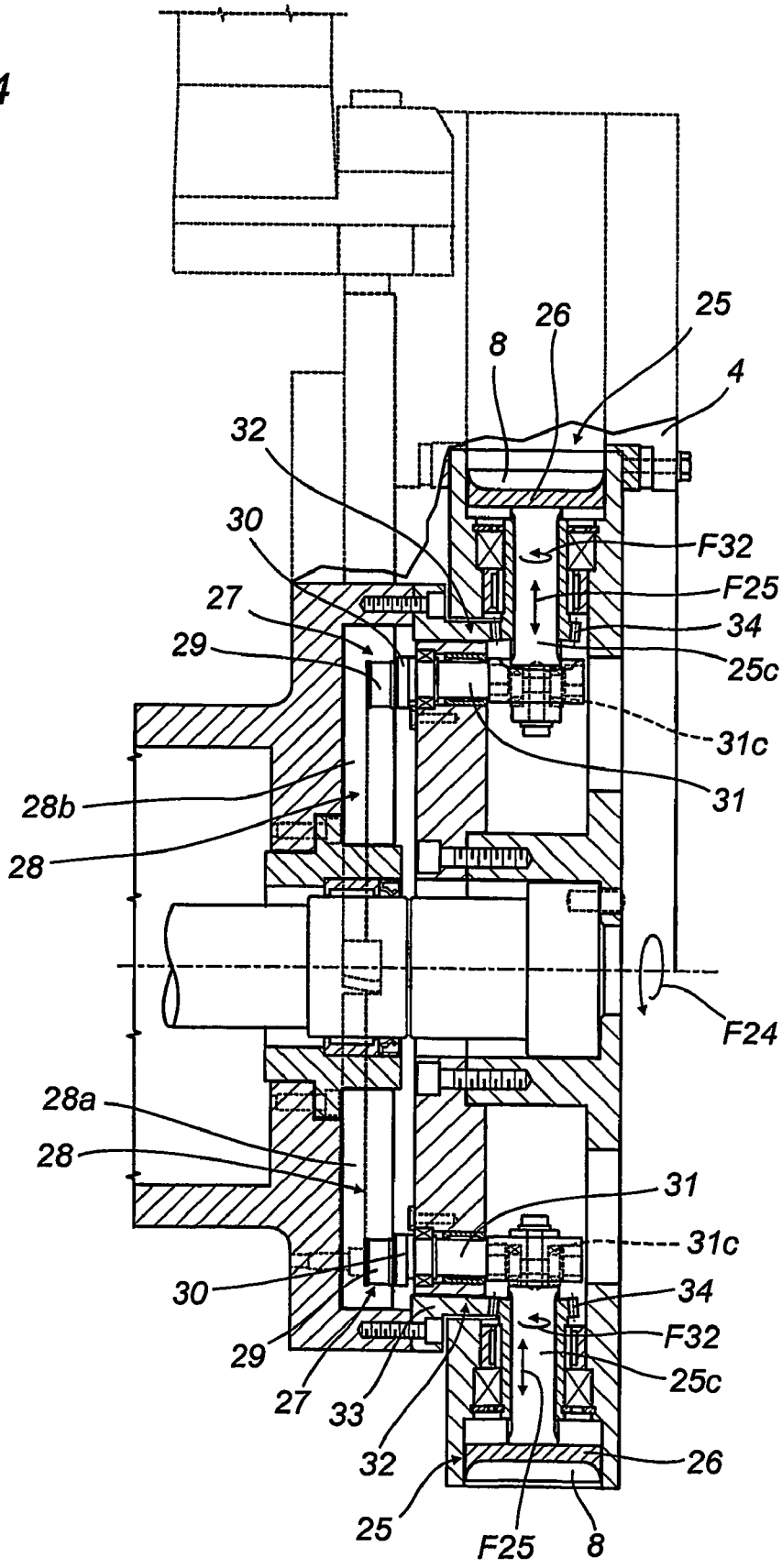
FIG. 4 is a cross-section through line IV-IV of FIG. 3.

FIGS. 3 and 4 show that the first revolving drum 24 is equipped with a plurality of pistons 25 arranged radially on the surface of the first drum 24, each piston 25 having a hollow head 26 defining the impression 8 for receiving a dose of the product fed by the hopper 23.

As illustrated in detail below, each of the pistons 25 can perform a series of synchronised movements in a radial direction, thanks to drive means 27, while also rotating continuously about its axis in such a way as to allow the disk 2 to be properly formed as described above and at the same time keeping the disk 2 compressed and detached from the walls of the hollow head 26 defining the impression 8.

To do this, the aforementioned radial drive means 27 are fitted between each piston 25 and the first drum 24 to act upon the pistons 25 in such manner as to impart the plurality of synchronised movements to the pistons 25 according to their angular positions on a circular path, labelled P, and so as to:

receive the product;

compress the product to form the disk 2; and detach and deposit the disk 2 onto the first web 5 of filter paper.

Looking in more detail, the radial drive means comprise cam means 27 consisting of at least one guide cam profile 28 stably associated with the interior of the first drum 24 and engaged by a cam follower roller 29 for each piston 25.

Each cam follower roller 29 is rigidly attached to the end of a respective connecting rod 30 whose other end is associated with a control pin 31 rotatably connected to the inside end of the cylinder 25*c* of the piston 25 so as to drive the piston 25 radially in both directions according to the angular position of the piston 25 on the circular path P.

In other terms, the control pin 31 is in rotatable contact, through a bearing 31*c*, with the base of the cylinder 25*c* so as to drive the piston 25 backwards and forwards (see arrows F25) according to the movements of the cam follower roller 29.

Figure 5:
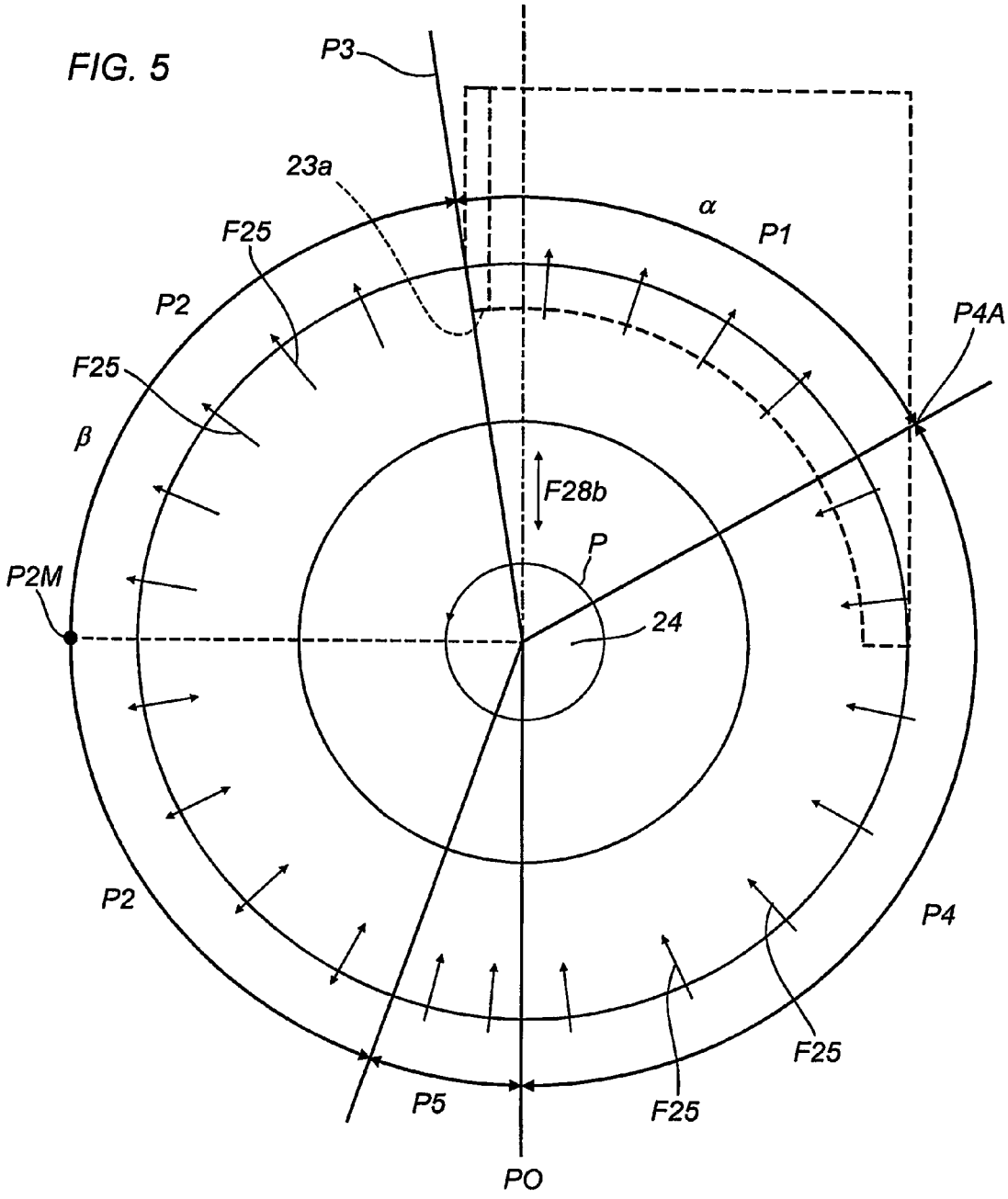
FIG. 5 is a side view illustrating the motion of the forming means of FIG. 3.

The movements of the pistons 25 are indicated in the diagram of FIG. 5. As shown, each piston 25 starts at an imaginary zero point P0 where it is perpendicular to the first belt 19, and performs the following movements:

in a first section P4 the piston 25 is moved radially towards the inside of the first drum 24 to a product dosing position, that is to say, in such a way that the head 26 is moved away from the arc-shaped section of the hopper 23 and the piston 25 reaches a point P4A corresponding to its bottom dead centre;

in the aforementioned dosing path P1, the piston 25 is initially away from the arc-shaped section of the hopper 23, so as to collect as much product as possible in the head 26, and then starts moving a little in a radial direction towards the outside of the first drum 24 until it reaches the endpoint P3 of the hopper 23 where there is a wall 23*a* for levelling off the product accommodated in the impression 8;

during feed along the path P2 for tamping the disc 2, the piston 25 continues moving radially towards the outside of the first drum 24 and against a stop wall 35 until it reaches its top dead centre, corresponding to the point P2M, where it remains until it starts on a path section P5;

thus, just before returning to the zero point P0 where the disk 2 is released, the piston 25 starts moving back up along the arc-shaped path section P5 in order to facilitate detachment of the disc 2 from the impression 8.

To enable these movements to be performed precisely, the cam profile 28 is divided into two arc-shaped sections 28*a*, 28*b*, a fixed lower section 28*a* and an adjustable upper section 28*b* corresponding to the part of the path P of the pistons 25 comprising at least the dosing path P1: this makes it possible to accurately gauge the positions between the impression 8 and the hopper 23 so as to control the volume of product that goes into the impression 8.

More specifically, the half are defining the section 28*b* can be adjusted, in both directions, as indicated by the arrow F28*b*, so as to increase or decrease the distance between the piston head 26 and the levelling off point P3 corresponding to the volume of product inside the head 26 but without changing the endpoints of the half arc 28*b*.

As mentioned above, the pistons 25 can rotate continuously about their axes (see arrow F32 in FIG. 4) thanks to rotational drive means 32 located on the first drum 24 and acting on each piston 25.

The rotational drive means 32 may comprise a fixed ring gear 33 mounted inside the first drum 24 and meshed with corresponding gear wheels 34 keyed to the respective cylinder 25*c* of each piston 25 so that the pistons 25 revolve continuously as they move round the circular path P.

The rotation of each piston 25 has the effect of tamping the disk 2 but without allowing the surface of the product to adhere to the surface of the head 26 of the piston 25 within the impression 8: this means that when the disk 2 is subsequently released onto the first web 5 of filter paper, the disk 2 is detached fully and cleanly.

As mentioned above, there are arc-shaped walls 35 and 36 round the outer surface of the first drum 24 designed to permit the pistons 25 to be pushed against the impressions 8 of the pistons 25 in a part of the circular path P and in such a way as to co-operate with the pistons 25 at least when the disk 2 is formed and compressed.

As also mentioned above with reference to the steps in the method according to the invention, the first web 5 of filter paper may be fed along a slightly inclined path at least when it is in the general vicinity of the outside surface of the drum 24 where the piston 25 starts retracting just before releasing the disk 2 on the first web 5: this further improves detachment of the disk 2 from the head 26 of the piston 25.

Returning to FIG. 1, the station 14 that forms a counter-impression 7 in the second web 6 of filter paper may comprise a second drum 37 presenting a plurality of recesses 38 distributed uniformly on its outer surface around which the second web 6 of filter paper moves.

The second drum 37 is acted upon by means 39 that form the counter-impression 7 in the second web 6 of filter paper.

In a non-restricting embodiment of the invention provided purely by way of example, the forming means 39 act on a part of the outer surface of the drum 37 and consist of a section of a second endless forming belt 39 equipped with protrusions 40 positioned and shaped to match the recesses 38 as the latter move round: these protrusions make the counter-impressions 7 in the second web 6 which is moving along between the second drum 37 and the second belt 39.

The forming action is accomplished by drawing spaced areas of the second web 6 into the recesses 38 and holding them inside by suction generated within the second drum 37.

The aforementioned associating station 13 is located under the second drum 37 and may comprise a circular sealing element 41 designed to join the first web 5, which accommodates the disk 2, to the second web 6 of filter paper placed over the disk 2 to form a succession of sealed pods 1.

The sealed pods 1 are fed to the aforementioned cutoff station 15 which may comprise a circular knife 15*a* and a counter-knife 15*b* positioned on opposite sides of the feed line A of the first and second webs 5 and 6 of filter material sealed to each other and forming a succession of pods 1 which, in this preferred embodiment, are circular.

After being cut, the circular pods 1 are separated from the waste material 17 at the station 16, for example by an ejection device 16*a*, while the waste material 17 is collected at the recovery station 18 (for example by suction).

After being separated, the pods 1 are conveyed to further packaging stations which are not illustrated.

A method and apparatus as described above permit pods containing an infusion product to be made extremely rapidly with precisely measured doses of product and cleanly formed product disks.

The special structure of the dosing and forming unit makes it possible to achieve high production speeds even using single rows of impressions on the webs of filter paper, thus making apparatus design simpler and more flexible.

The possibility of first forming the product disk and then placing it on a flat web of filter paper makes it possible to improve the efficiency and reduce the size of the apparatus thanks to a more streamlined production line.

The dosing and forming station creates an extremely compact and clean disk of precisely dosed product thanks to the simultaneous translational and rotational movements of the forming pistons: the translational movement controls the steps of dosing, forming and releasing the product disk, whilst the rotational movement enables the disk to be tamped quickly and in a short path length and without allowing it to adhere to the surface of the impression.

The invention described has evident industrial applications and may be subject to modifications and variations without thereby departing from the scope of the inventive concept. Moreover, all the details of the invention may be substituted by technically equivalent elements.

The invention claimed is:

1. A method for making pods of filter material containing products for infusion, the method comprises the following steps:

making at least one compressed disk of product, equivalent to a dose of the product, at respective dosing and forming stations, said step of making the disk comprising a step of tamping to compress the product within an impression by the use of a forming piston having a longitudinal axis by translating said forming piston along said axis and rotating said forming piston about said axis; and forming the a pod with the compressed disk positioned inside the filter material, wherein the step of making the disk further comprises the sub-steps of:

dosing a quantity of the product in said impression while moving along a first defined path of the forming station; and compressing the dose of product inside the impression by use of the forming piston while moving along a second defined path following the first path.

2. The method according to claim 1, wherein the pods comprise two pieces of filter material placed over each other and sealed and containing a dose of the product for infusion, the method further comprising the following steps:

feeding a first portion of filter material;

making the compressed disk of product, equivalent to a dose of the product, at said respective dosing and forming stations;

depositing the compressed disk on the first portion of filter material; and associating a second portion of filter material with the first portion of filter material to encapsulate the compressed disk to form the pod.

3. The method according to claim 2, wherein the first and second portions of filter material are obtained from webs of the same filter material.

4. The method according to claim 2, wherein the first portion of filter material is obtained from a web fed in a straight line.

5. The method according to claim 2, wherein between the step of depositing the compressed disk and the associating step there is a further step of making in the second portion of filter material a counter-impression shaped to match the disk and designed to be placed over the disk.

6. The method according to claim 2, wherein the depositing step is accomplished by allowing the compressed disk to drop out of said impression by gravity onto the first portion of filter material.

7. The method according to claim 2, wherein the depositing step is accomplished by allowing the compressed disk of product to drop out of said impression by gravity onto the first portion of filter material and said disk is held in place on the first portion of filter material by suction.

8. The method according to claim 2, wherein the step of associating the first and second portions of filter material is performed by heat sealing.

9. The method according to claim 2, wherein the associating step is followed by a step of cutting the first and second portions of filter material to form the pod.

10. The method according to claim 1, wherein between the dosing and compressing sub-steps there is a step of leveling off the dosed product inside the impression.

11. The method according to claim 1, wherein the first and second defined paths are arc-shaped and cover respective angles ($\alpha$) and ($\beta$) following each other.

12. An apparatus for making pods containing products for infusion, the pods each comprise two pieces of filter material placed over each other and sealed and containing a dose of the product for infusion; the apparatus comprising:

at least two independent stations for feeding first and second portions of filter material;

a station for feeding the first portion of filter material in a feed direction;

means for forming a disk of the infusion product and releasing the disk onto the first portion of filter material;

a station for dosing individual doses of the product into said means for forming and releasing; and a station for associating the first portion of filter material with the second portion of filter material to form the pod;

wherein the feed station for the first portion of filter material further comprises:

a first endless belt trained around a pair of sheaves and having a perforated or porous surface; and means for creating a vacuum at least at a working section of the first belt which feeds the first portion of filter material and on which the product disk is deposited.

13. The apparatus according to claim 12, wherein downstream of the dosing station and means for forming and releasing, in the feed direction, the apparatus further comprises a station for making a counter-impression in the second portion of filter material and placing the counter-impression over the product disk.

14. The apparatus according to claim 12, wherein the two stations for feeding the filter material unwind respective webs of the filter material.

15. The apparatus according to claim 12, wherein downstream of the associating station, the apparatus further comprises a station for cutting off the disk encapsulated in the two portions of filter material to form a pod.

16. The apparatus according to claim 15, further comprising a station for separating the pod from waste material, which waste material is collected in a recovery station.

17. The apparatus according to claim 15, wherein the cutting off station comprises a circular knife and a counter-knife positioned on opposite sides of a feed line of the first and second portions of filter material sealed to each other and forming a succession of pods.

18. The apparatus according to claim 12, wherein the dosing station comprises a fixed hopper mounted to face a first revolving drum, forming part of the means for forming and releasing; the hopper having an arc-shaped discharge portion to peripherally follow a passing surface of the first drum in such manner that the product is dosed in a predetermined area.

19. The apparatus according to claim 12, wherein the means for forming the disk comprises:

a first revolving drum equipped with a plurality of pistons arranged radially on the surface of the first drum and each piston located in a hollow head designed to receive a dose of the product fed by the dosing station; and radial drive means being provided between each piston and the first drum to act upon the pistons in such manner as to impart a plurality of synchronized movements to the pistons according to their angular positions on a circular path and so as to receive the product, compress the product to form the disk, detach and deposit the disk onto the first portion of filter material.

20. The apparatus according to claim 19, wherein the radial drive means comprises cam means including at least one guide cam profile stably associated with the interior of the drum and engaged by a cam follower roller for each piston; each cam follower roller being attached to the end of a respective connecting rod whose other end is associated with a control pin rotatably connected to the inside end of the hollow head of the piston so as to drive the piston radially in both directions according to the angular position of the piston on the circular path.

21. The apparatus according to claim 20, wherein the cam means causes each piston to be positioned according to movements referenced to a relative position or angular section of the circular path and corresponding to:

a first arc-shaped path section where the piston is radially retracted towards the center of the first drum in such a way that the piston moves into a product dosing configuration when the piston reaches a point corresponding to a bottom dead center of the piston;

a second arc-shaped path section for dosing where the piston is initially at the bottom dead center, in such manner as to collect as much product as possible in the hollow head, and moves in a radial direction towards the outside of the first drum until the piston reaches the endpoint of the dosing station where there is a wall for leveling off the product accommodated in the hollow head; and a third arc-shaped path section for tamping the disc, where the piston moves radially towards the outside of the first drum and against a stop wall corresponding to a top dead center of the piston where the piston remains until the piston starts on a fourth arc-shaped path section where the piston moves towards the center of the first drum in order to facilitate detachment of the disc from the hollow head just before reaching the point where the disc is released.

22. The apparatus according to claim 20, wherein the cam profile is divided into two arc-shaped sections, a fixed lower section and an adjustable upper section corresponding to a part of the path of the pistons comprising at least one area where the product is filled into the hollow heads.

23. The apparatus according to claim 19, wherein each piston has a longitudinal axis, and the first drum is equipped with rotational drive means acting on each piston and designed to continuously revolve each piston about said axis; the rotational drive means comprising a fixed ring gear mounted inside the first drum and meshed with corresponding gear wheels keyed to the respective hollow head of each piston so that the pistons revolve continuously as they move round the circular path, thus tamping the disk and preventing the disk from sticking inside the hollow head of the piston while enabling the disk to be detached completely when it is deposited on the first portion of filter material.

24. The apparatus according to claim 19, further comprising arc-shaped walls located round the outer surface of the first drum, the pistons pushing the product against the arc-shaped walls in a part of the circular path and in such a way as to co-operate with the pistons at least when the disk is formed and compressed.

25. The apparatus according to claim 19, wherein the first portion of filter material is fed close to the first drum along an inclined path that partially and peripherally follows the surface of the first drum in an area close to where the disk is deposited on the first portion of filter material.

26. The apparatus according to claim 19, wherein downstream of the dosing station and the means for forming and releasing, in the feed direction, the apparatus further comprises a station for making a counter-impression in the second portion of filter material and placing the counter-impression over the product disk, and wherein the station for making the counter-impression on the second portion of filter material comprises a second drum presenting a plurality of recesses distributed uniformly on its outer surface to which the second portion of filter material is held by suction; one section of a second endless forming belt being located and operative on a portion of the surface of the second drum and being equipped with protrusions positioned and shaped to match the recesses as the latter move round, thus making a counter-impression on the second portion of filter material placed between the second drum and the second belt by pushing the second portion of filter material into the recesses.

27. The apparatus according to claim 26, wherein the associating station comprises a circular sealing element positioned under the second drum and designed to seal the first portion of filter material, with the disk thereon, to the second portion of filter material placed over the disk to form a succession of sealed pods.

28. A method for making pods of filter material containing products for infusion, the method comprises the following steps:

making at least one compressed disk of product, equivalent to a dose of the product, at respective dosing and forming stations, said step of making the disk comprising a step of tamping to compress the product within an impression by the use of a forming piston having a longitudinal axis by translating said forming piston along said axis and rotating said forming piston about said axis;

depositing the compressed disk on a first portion of the filter material; and forming the pod with the compressed disk positioned inside the filter paper.

* * * * *